US006951680B1

(12) United States Patent
Vaulot

(10) Patent No.: US 6,951,680 B1
(45) Date of Patent: Oct. 4, 2005

(54) PRINTED WELDABLE FLEXIBLE POLYMER MATERIAL FOR PRODUCING STRETCHED STRUCTURES SUCH AS FALSE CEILINGS

(75) Inventor: Eric Vaulot, Bondues (FR)

(73) Assignee: Newmat S.A., Haubourdin (FR)

( * ) Notice: Subject to any disclaimer, the term of this patent is extended or adjusted under 35 U.S.C. 154(b) by 0 days.

(21) Appl. No.: 10/089,593

(22) PCT Filed: Sep. 29, 2000

(86) PCT No.: PCT/FR00/02699

§ 371 (c)(1),
(2), (4) Date: Aug. 6, 2002

(87) PCT Pub. No.: WO01/23683

PCT Pub. Date: Apr. 5, 2001

(30) Foreign Application Priority Data

Sep. 30, 1999 (FR) ..... 99 12426

(51) Int. Cl.[7] ..... B32B 33/00

(52) U.S. Cl. ..... 428/195.1; 428/542.6; 428/542.8

(58) Field of Search ..... 428/32.1, 44, 53, 428/54, 57, 409, 542.2, 542.6, 542.8, 195.1; 52/222, 311.1, 311.2, 311.3, 506.06, 746.1; 427/746.1, 270–272, 276, 275, 256; 264/129, 264/288.4, 280, 132, 289.3, 291–293

(56) References Cited

U.S. PATENT DOCUMENTS 3,619,344 A * 11/1971 Wolinski et al. ..... 428/314.4
3,782,495 A * 1/1974 Nassof ..... 181/284
3,964,910 A * 6/1976 Geist et al. ..... 430/395
4,248,647 A 2/1981 Herron et al.
4,756,951 A * 7/1988 Wang et al. ..... 428/204
5,280,305 A * 1/1994 Monroe et al. ..... 347/129
5,339,587 A 8/1994 Ruhlmann
5,419,795 A * 5/1995 Wood et al. ..... 156/184
5,447,758 A 9/1995 Pelletier

FOREIGN PATENT DOCUMENTS

| | | |
|---|---|---|
| EP | 0 043 466 | 1/1982 |
| FR | 2524922 | 10/1983 |
| FR | 2 548 418 | 1/1985 |
| FR | 2 552 473 | 3/1985 |

(Continued)

OTHER PUBLICATIONS

English abstract of JP 02-200277.*

*Primary Examiner*—Chris Fiorilla
*Assistant Examiner*—Sing P Chan
(74) *Attorney, Agent, or Firm*—Ladas & Parry LLP

(57) ABSTRACT

Prefabricated bondable flexible polymer material in thin sheet, slab, or panel form for making tensioned structures such as false ceilings in particular, said mono- or multilayer material such as plasticized PVC, for example, carrying a direct ink jet or silkscreen print of at least one design of shapes and dimensions that are predetermined once the material is under tension; making a tensioned structure such as a tensioned false ceiling, in particular, from such a material, by means of a first step of selecting the type, dimensions, and dispositions of the mono- or polychromatic designs to be printed, said designs being digitized and recorded in a computer memory of a system for controlling a printing machine, printing optionally being performed on a plurality of bonded-together strips of material, and in particular over zones of edge-to-edge bonding between the strips, said printing taking place before or after bonding.

5 Claims, 3 Drawing Sheets

FOREIGN PATENT DOCUMENTS

| | | | | |
|---|---|---|---|---|
| FR | 2552473 | | 3/1985 | |
| FR | 2592416 | | 7/1987 | |
| FR | 2619531 | | 2/1989 | |
| FR | 2623540 | | 5/1989 | |
| FR | 2627207 | | 8/1989 | |
| FR | 2658849 | | 8/1991 | |
| FR | 2685036 | | 6/1993 | |
| FR | 2695670 | | 3/1994 | |
| FR | 2699209 | | 6/1994 | |
| FR | 2699613 | | 6/1994 | |
| FR | 2712325 | | 5/1995 | |
| FR | 2727711 | | 6/1996 | |
| FR | 2734296 | | 11/1996 | |
| FR | 2 738 847 | | 3/1997 | |
| FR | 2 739 082 | | 3/1997 | |
| FR | 2738847 | | 3/1997 | |
| FR | 2751682 | | 1/1998 | |
| FR | 2756600 | | 6/1998 | |
| FR | 2763615 | | 11/1998 | |
| FR | 2767851 | | 3/1999 | |
| JP | 02200277 | A * | 8/1990 | ..... A62C 35/58 |
| SE | 1214421 | | 12/1970 | |
| WO | WO 90 05640 | | 5/1990 | |
| WO | WO 9943906 | | 9/1999 | |
| WO | WO 9943907 | | 9/1999 | |

* cited by examiner

PRINTED WELDABLE FLEXIBLE POLYMER MATERIAL FOR PRODUCING STRETCHED STRUCTURES SUCH AS FALSE CEILINGS

The invention relates to the technical field of prefabricated flexible polymer materials for building and/or decoration, such materials being in sheet, slab, or panel form and of relatively small thickness, and they can be used in particular for making false ceilings or false walls, and more generally wall or ceiling coverings.

The invention also relates to a method of making such a material and to coverings obtained by tensioning such a material.

Numerous embodiments of such materials are known in the prior art, as are their use in making tensioned false ceilings.

By way of example, reference can be made to the French patent applications published under the following numbers: 2 767 851, 2 751 682, 2 734 296, 2 699 209, 2 695 670, 2 685 036, 2 627 207, 2 623 540, 2 619 531, 2 592 416, 2 552 473, and 2 524 922.

Reference can also be made to the following French patent applications in the name of the Applicant: 2 736 615, 2 756 600, 2 727 711, 2 712 325, 2 699 613, and 2 658 849.

Flexible polymer materials for making tensioned false ceilings and false walls and known in the prior art are provided with numerous qualities such as, in particular: fire resistance, proofing against air as well as dust or moisture; ease of cleaning.

The resulting false ceilings can incorporate sound or heat insulation, spotlamps or various kinds of lighting, and also openings for ventilation or airing, sprinklers.

Since they can be dismantled, they make it possible, where necessary, to perform work inside the plenum.

Such polymer materials, which can be translucent or opaque, being optionally bulk dyed, mat, gloss, marbled, with a suede or a glazed finish, can thus be used in industrial or hospital settings, in canteens, laboratories, or dwellings.

A gloss finish can provide a mirror effect which is often used in commercial centers, whereas a mat finish rather close to plaster in appearance is more usual in traditional decoration.

Tensioned false ceilings or tensioned false walls are installed on a made-to-measure basis, which requires polymer sheet material to be cut and assembled.

In spite of their numerous advantages that have led to them being used increasingly in a wide variety of premises, tensioned polymer sheet false ceilings and false walls as known in the prior art suffer from two drawbacks:

- when they are of large size, their uniform and regular appearance can appear too artificial or monotonous and this can make them unsuitable for use in certain conventional or historical architectural settings; and
- when implemented in conventional manner in the form of a series of strips, in spite of a degree of variety in finishes and bulk dying, they do not always make it possible to achieve personalization that matches the taste of a purchaser or the style of premises in which they are to be installed.

To mitigate those drawbacks, it might be thought that the sheets of materials used for making tensioned false ceilings or false walls could be printed.

Document FR-A-2 738 847 describes a fabric for false ceilings which is described on page 2, lines 30–31 as being "easily printed (silkscreen printing) or painted". The fabric in question comprises a polyester cloth substrate, in particular a jacquard knit with a herringbone weave, coated in a plastisol on at least one face. That fabric is put into place at ambient temperature, so that mechanical characteristics, and in particular elongation in the warp and the weft directions, remain substantially identical, thereby avoiding any defective appearance after cooling (page 1, line 10–page 2, line 15 of document FR-A-2 738 847).

However, false ceilings are rarely put into place at ambient temperature since that requires the operator to exert a large amount of physical force, particularly when ceilings are of large area.

The conventional hot technique of installing tensioned ceilings gives rise, a priori, to severe difficulties if the ceilings are printed. These difficulties are mentioned in document WO-A-99/43907 (page 1, lines 25–30): tensioning such sheets after they have been printed can lead to images becoming distorted.

As a result, known printed false ceilings are in the form of suspended slabs of small area (typically 1 square meter ($m^2$) with the printing of small areas presenting no technical problem.

The invention seeks to provide a material and a method for making printed tensioned false ceilings and false walls of large area, and suitable for enabling said false ceilings or false walls to be put into place while hot.

To this end, in a first aspect, the invention provides a bondable flexible polymer material in the form of thin sheets, slabs, or panels, that are prefabricated for making tensioned structures such as false ceilings, in particular, said material carrying direct printing of at least one design of shapes and dimensions that are predetermined after the material has been put under tension.

In a second aspect, the invention provides a method of making a tensioned structure such as a tensioned false ceiling, in particular, using a material as defined above, the method comprising a first step of selecting designs to be printed on the material, said designs being mono- or polychromatic and being capable of being modified in shape, color, proportions, and dispositions, said designs being digitized and recorded in a computer memory of a system for controlling a printing machine.

In a third aspect, the invention provides tensioned structures including such printed flexible materials.

Other objects and advantages of the invention appear from the following description of embodiments, which description is given with reference to the accompanying drawings, in which.

In the text below, mention is made only of an application to tensioned false ceilings.

Nevertheless, it should be understood that the description can be transposed by a person skilled in the art to tensioned false walls, and more generally, to any wall covering using a flexible polymer material in the tensioned sheet form.

Figure 1:
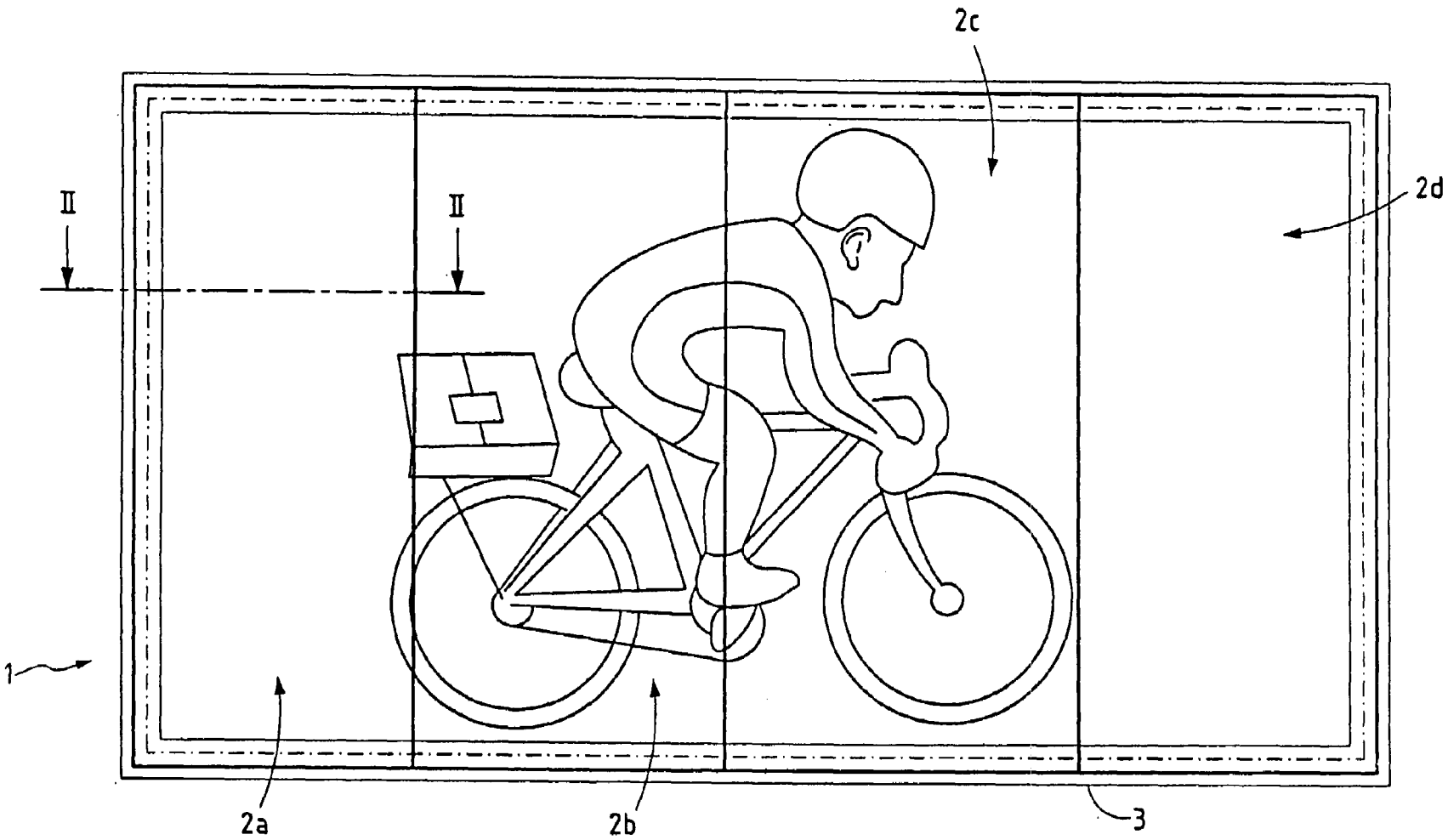
FIG. 1 is a plan view of a false ceiling comprising four printed strips in one embodiment of the invention.
Figure 2:
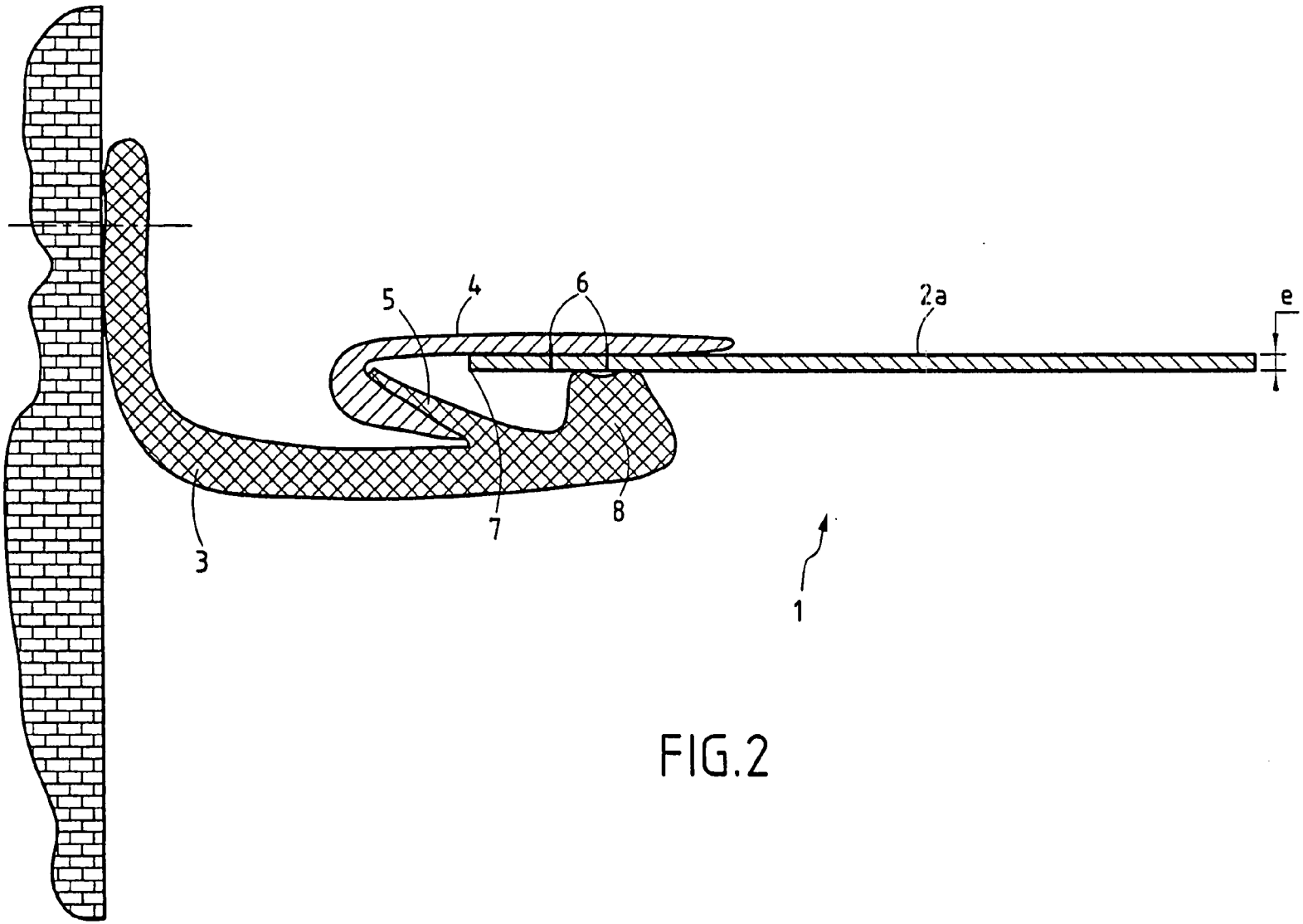
FIG. 2 is a diagrammatic cross-section on plane II—II of FIG. 1.

The false ceiling 1 shown in FIG. 1 is rectangular in outline, being made up of an assembly of four strips 2*a*, 2*b*, 2*c*, and 2*d* of substantially identical width l.

Nevertheless, it should be understood that the false ceiling could be of some other outline, depending on requirements, and could be made up by assembling together some larger or smaller number of strips, which need not necessarily be identical in width.

Where appropriate, the false ceiling could comprise a single strip only, e.g. when used in a relatively narrow space such as a corridor.

The false ceiling 1 comprises a frame 3 made using rails, with the free edges of the assembled-together strips having margin members 4 or hooks co-operating with catch members 5 on the frame 3 by simple engagement or by positive hooking.

The margin members 4 can be secured by bonding 6 close to the edges 7, said bonding being masked from sight, e.g. by a portion 8 of the rails.

Various other ways of securing the strips to the rails and various known forms of rail can be implemented when the strips are made of a flexible polymer material of the invention.

Consequently, the ways in which the strips are mounted on the frame are not described in greater detail herein.

In certain embodiments of the invention, the polymer material is selected from: thermoplastic polymers such as plasticized polyvinyl chloride (PVC) and polymers derived therefrom such as superchlorinated vinyl chloride, polyvinylidene chloride, and copolymers of vinyl chloride and of polyvinylidene chloride.

In certain particular embodiments, the material is a multilayer material, e.g. made by co-extrusion.

Where appropriate, the material can be mono- or bi-oriented.

The thickness e of the material lies in the range a few tenths of a millimeter to a few millimeters.

The material can be translucent or dyed in its bulk, so as to being capable of presenting a wide variety of colors; it can have finishes that are gloss, marbled, mat, suede, or glazed as selected by the user.

In an embodiment, the material is provided with flocking so as to give it a velvet or fabric appearance. By way of example, the surface of the material is coated in an adhesive suitable for finely-cut textile fibers, the fibers of the flocking being applied by screening and beating or by being blown under pressure, or indeed electrostatically when a high density of fibers is desired.

In order to enable the false ceilings to be adapted to the style desired for the premises in which it is to be mounted, or in order to enable the false ceiling to be personalized, it can carry a design D printed directly thereon.

The printing can be silkscreen printing or digital printing using an ink jet.

In a particular embodiment, the printing is performed in a single stage in order to produce a design of large dimensions, e.g. inscribed in a circular envelope having a diameter of the order of two to three meters.

There follows a description of various implementations of a method of making such printed tensioned ceilings.

In a first step, a design is selected, e.g. from a paper or digital catalog.

With a digital catalog, the printing machine can be controlled directly or indirectly by the computer system in which the selected design is stored.

By way of example, the catalog can comprise reproductions of classical works such as famous painted ceilings, and also reproductions of modern works, color photographs, or cartoon characters.

The catalog can have several color schemes for the same design, with it being possible, where appropriate, for the user to request a modification to the design or the color scheme given in an example in the catalog.

Several catalog designs can be selected for printing simultaneously.

In a variant implementation, the user can select a pattern that is not included in the catalog, for example, a personal photograph, or the logo of a business or some other body.

The designs that are selected can optionally be line drawings, and they can be monochrome or polychrome.

Where appropriate, the color and the finish of the printed material are matched to the colors of the selected design and/or to the colors of the premises in which the false ceiling is to be installed, or indeed to the desired style.

In an implementation of the method, the selected design is repeated so as to form an optionally regular pattern, with the individual designs being spaced uniformly or otherwise.

In a variant, at least two designs differing in shape and/or size and/or color can be repeated so as to form an optionally regular alternation.

The size of any selected design can be matched to the dimensions of the final false ceiling.

The position of any selected design can likewise be adapted to any looked-for effect.

Thus, for example:

- a drawing reproducing artificial old-fashioned ceiling moldings can be placed centrally on the false ceiling around a chandelier or other lighting system placed in the center of the ceiling; and
- a design reproducing wallpaper patterns can be placed at the margins of the false ceiling so as to extend those patterns, so to speak.

The selected design can thus be placed in the center or at the periphery of the false ceiling, covering substantially its entire surface area or only a portion thereof.

Where appropriate, only a portion of a catalog design need be selected for printing purposes.

Once this first step of selecting the shapes, locations, and colors of the design(s) has been performed, an optional second step of printing on paper or some other low-cost medium can be carried out in order to enable the user to view, at little cost, the final effect that will be obtained after the false ceiling has been put into place.

Such printing on paper can be performed on a medium of large size, e.g. having a width in excess of two meters, using the same machine as is used for printing the sheets of flexible polymer material.

Once the user has confirmed the selected design, a third step of printing proper on the sheet of flexible polymer material can be performed in the factory, away from the site where the tensioned false ceiling is to be installed.

Figure 3A:
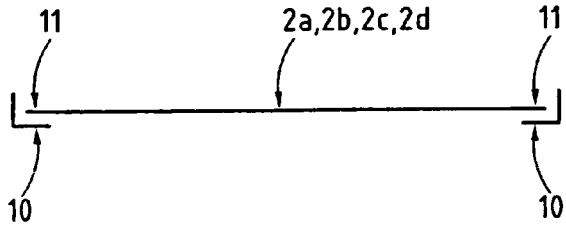
FIGS. 3A and 3B are two diagrammatic cross-section views through the strips, showing two implementations of the method of the invention.

In one implementation of this third step, printing is performed strip by strip, as represented diagrammatically in FIG. 3A.

A single design can optionally extend over a plurality of printed strips prior to assembly.

When the strips are assembled together by bonding, a protective flap 10 can be put into place in the vicinity of each side edge 11 of the strips so as to enable bonding to be taken up after printing has been performed.

Bonding can be performed using ultrasound, high frequency, heat-sealing, etc. as a function specifically of the chemical nature of the flexible polymer material used.

When the nature of the inks used for printing is incompatible with the methods used for bonding, a mask or some other means suitable for protecting the side edges 11 of the strips should be put into place in the printing machine.

In another implementation of the third step of printing the strips (FIG. 3B), the printing is performed after the strips have been bonded together.

In this implementation, printing is performed on a plurality of bonded-together strips of material, and in particular it is performed over the edge-to-edge bonding zones between the strips.

Figure 3B:
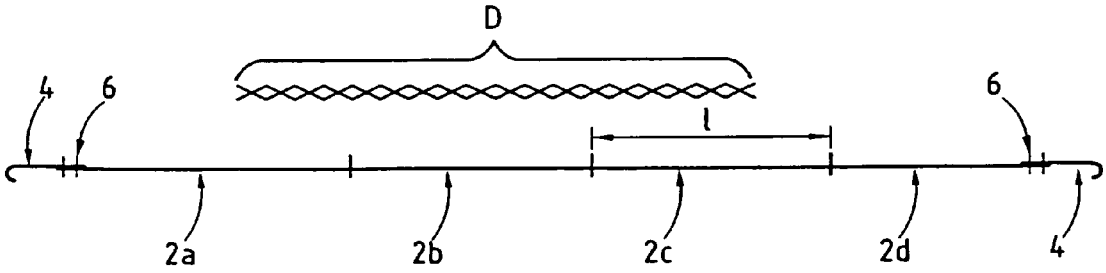

This second implementation can correspond both to a design D that extends over a single strip, and to a design that extends over a plurality of strips, as shown diagrammatically in FIG. 3B.

The inks and varnishes used during the printing third step are treated, in one implementation, so as to be protected against ultraviolet radiation.

The same may also apply to the flexible polymer material carrying the printing, so as to prevent it aging by photo-oxidation, particularly when PVC is used.

As is known to the person skilled in the art, the inks and varnishes should be selected in such a manner as to be capable of deforming while the false ceiling is being put into place.

Were appropriate, when the bonding between the strips can give rise to unbalanced lengthening of the strips during installation of the false ceiling, the design can be corrected locally in such a manner as to obtain a design having the correct proportions after installation.

For printing the strips, a reference point can be taken that is remote from the edges of each strip, being substantially in the geometrical center of the sheet, so as to take account of strip lengthening during tensioning.

In order to limit image distortion during tensioning of the strips, the polymer material can be mono- or bi-oriented.

The strip(s) of printed flexible polymer material can be assembled to conventional non-printed flaps of material so as to form a tensioned sheet for a false ceiling or a false wall.

By an appropriate selection of printed patterns, the resulting false ceilings can easily be adapted to a very wide variety of surroundings, in particular for internal decoration of historic homes, or premises for special occasions.

By printing a design that is predeformed, it is possible to put a false ceiling or a false wall into place while hot, the design returning to its desired outlines and proportions when the sheet material cools.

As is known, per se, hot installation makes it easier to put the false ceiling or false wall into place because the sheet material used expands thermally.

In another implementation, printing is performed on the sheet material for the false ceiling or false wall while it is in the tensioned state, with its tension then being substantially identical to the tension that will subsist after the false ceiling or false wall has been put into place.

What is claimed is:

1. A prefabricated material for making hot-tensioned structures to form a false ceiling or a false wall, the material comprising:

one or more thin flexible sheets;

each sheet being sized and configured to be retained in a respective frame in a tensioned state at an ambient temperature;

each sheet including direct printing of predeformed designs of shapes and dimensions, the predeformed designs taking account of differential lengthening of the printed material during hot-tensioning, said predeformed designs substantially compensating for distortion in the design caused by the being hot-tensioned, and thus ensuring that a properly proportioned design is obtained on the tensioned printed material.

2. The material according to claim 1, wherein multiple sheets having said predeformed designs printed thereon are assembled together by bonding.

3. The material according to claim 1, wherein the material is selected from the group comprising thermoplastic polymers including plasticized polyvinyl chloride and polymers derived therefrom as superchlorinated vinyl chloride, polyvinylidene chloride, and copolymers of vinyl chloride and polyvinylidene chloride.

4. The material according to claim 1, wherein the material is a multilayer material.

5. The material according to claim 1, wherein the material is mono- or bi-oriented.

* * * * *